US005234281A

United States Patent [19]

Somero et al.

[11] Patent Number: 5,234,281

[45] Date of Patent: Aug. 10, 1993

[54] DEFLECTION INDICATING ADJUSTABLE HIGHWAY STRAIGHT-EDGE

[75] Inventors: David W. Somero; Paul J. Somero, both of New Ipswich, N.H.; William W. Niemela, Chassell; Philip J. Quenzi, Atlantic Mine, both of Mich.

[73] Assignee: Somero Enterprise, Inc., New Ipswich, N.H.

[21] Appl. No.: 821,019

[22] Filed: Jan. 15, 1992

[51] Int. Cl.[5] ..... E01C 19/26

[52] U.S. Cl. ..... 404/84.5; 33/286; 404/97

[58] Field of Search ..... 404/84.1, 84.2, 84.5, 404/84.8, 97, 101; 138/103; 33/286

[56] References Cited

U.S. PATENT DOCUMENTS

| | | | |
|---|---|---|---|
| 4,655,633 | 4/1987 | Somero et al. | 404/84.5 |
| 4,838,730 | 6/1989 | Owens | 404/97 |
| 5,082,028 | 1/1992 | Jean-Jacques | 138/103 |
| 5,084,980 | 2/1992 | Skopec et al. | 33/286 |
| 5,096,330 | 3/1992 | Aitzberger | 404/97 |

*Primary Examiner*—William P. Neuder
*Attorney, Agent, or Firm*—William B. Ritchie

[57] ABSTRACT

A deflection indicating adjustable highway straight-edge. The highway straight-edge is designed to effectively level wet concrete by allowing the user to determine when the device is not straight and provides the user with a means of controlled adjustment for straightening.

In the preferred embodiment, a laser light beam and electronic sensing device is used to detect deflection of the straight-edge. Undesirable deflection can be eliminated through the external adjustment of steel tension cables inside the straight-edge tube. In an alternative embodiment of the invention, deflection is detected by means of an electrically conducting wire having contact points to indicate that the straight-edge requires adjustment. In another embodiment, a steel wire or string line stretched tightly inside the straight-edge tube indicates deflection requiring adjustment.

9 Claims, 15 Drawing Sheets

DEFLECTION INDICATING ADJUSTABLE HIGHWAY STRAIGHT-EDGE

BACKGROUND OF THE INVENTION

1. Field of the Invention

The invention relates to an apparatus for leveling wet concrete that exhibits the ability to detect, indicate and adjust its own deflection through the use of a laser light beam and electronic sensing device.

2. Description of Related Art

In the construction industry a long straight beam called a straight-edge is often used during the leveling of wet concrete. In its most primitive form, a long straight piece of wood is used to cut down high and fill in low spots or "strike off" the uneven concrete. This process is called screeding.

Screeding distributes and places the concrete but does little in providing a quality finished surface. Another tool, often called a "bull float", is then used to produce the desired smooth quality surface texture. Because it is shorter than a straight-edge, use of the bull float disturbs the flatness of the concrete after screeding, creating new high and low areas despite the smoother surface texture.

For a number of reasons, simply using a longer bull float proves unsatisfactory. In order to achieve the degree of flatness specified in many current construction projects an especially accurate and true straight-edge is again used on the concrete. The history of this highly accurate straight-edge may be traced to its use in leveling roadway surfaces during highway construction. For this reason the name "highway straight-edge" is most often used to describe such a tool.

Used as a hand tool, a highway straight-edge can commonly range in length from 6 to 16 feet (1.8 to 4.8M) and can be handled by one man. In some situations it is utilized in the initial screeding process as a standard straight-edge with workmen stationed at each end. In primary applications, a long handle is attached to the center of the beam to be used by a single workman. A special mechanical device is used at the point where the handle attaches to the beam. This mechanism allows the user to readily adjust the angle of the straight-edge beam, normal to the surface being leveled, as it is pulled and pushed over the wet concrete. This angle adjustment is beneficial in allowing the straight-edge to remove the high and low areas caused by bull floating without affecting the smooth finish created by that process.

A highway straight-edge beam can be made from a variety of materials. However, due to the nature of usage, including contact with wet concrete, each type of material utilized for a highway straight-edge exhibits its own advantages and disadvantages in terms of effectiveness, durability, weight, cost and service life.

The evolution of the highway straight-edge has led to the use of extruded magnesium tubing of rectangular cross section to act as a beam. Low weight and relative rigidity makes this material suitable for the application.

A problem arises however as the straight-edge tube experiences normal wear due to abrasion from contact with the concrete. This normal wearing away of material from the contact face brings about an asymmetric cross section of material about the original neutral axis of the tube. The extruded magnesium tube contains balanced internal stresses which is inherent of the extrusion manufacturing process. As the cross section of the beam becomes progressively asymmetric due to wear, the internal stresses also become unbalanced and the straight-edge tube becomes curved or bowed. This bowing or deflection occurs relatively soon in the life of the straight-edge and is most apparent at the center of longer tubes.

A deflected or bowed straight-edge must be straightened if it is to continue useful service. Presently no accurate method of straightening is available and replacement is costly.

One common straightening procedure is to support the straight-edge at its ends with the bowed center arching upward. Then a heavy workman attempts to use his weight by gravity at the center to bend the tube straight, often with unsatisfactory results. Typically either a string line is stretched from end to end or a visual inspection along the length of the tube is used to gauge the degree of straightness correction achieved.

Specifications for concrete floors in many current construction projects require ever higher degrees of flatness. A ready means of detecting undesirable deflection of a highway straight-edge, in addition to providing for its correction through controlled adjustment, is not found in the prior art.

SUMMARY OF THE INVENTION

It is an object of the invention to provide a deflection indicating adjustable highway straight-edge which detects and indicates deflection through the use of a laser light beam and electronic sensing devices.

It is also an object of the invention to provide a deflection indicating adjustable highway straight-edge which detects and indicates deflection without electronic circuits thus reducing complexity and cost.

It is still another object of the invention to provide a deflection indicating adjustable highway straight-edge that detects and indicates deflection with sight-wire to further reduce complexity and cost.

It is still another object of the invention to provide deflection indicating adjustable highway straight-edge that resists deformation under stress.

It is still another object of the invention to provide a deflection indicating adjustable highway straight-edge that indicates when the straight-edge is straight and in no need of adjustment, or when it becomes bowed and in need of adjustment.

It is still another object of the invention to provide a deflection indicating adjustable highway straight-edge which is adjustable to compensate for the unbalanced internal stress due to wear and can be returned to the desired straightening effect.

It is still another object of the invention to provide a deflection indicating adjustable highway straight-edge that finishes concrete to meet the specified degree of flatness.

The invention is a deflection indicating adjustable highway straight-edge. A substantially rectangular tube is provided with a plate at each end. The tube has a flat straight bottom surface. At least one adjustable cable is provided. It is stretched within said tube and attached to said end plates. Adjusting means, connected to said cable, is provided for adjusting the tension of said cable. Deflection sensing means is provided that produces a signal representative of the deflection of the bottom surface of said tube from its straight condition. Indicating means for transforming the signal produced by said deflection sensing means is provided which indicates to the user when sufficient tension has been applied to said adjustable cable to restore the bottom of said tube to its straight condition.

DETAILED DESCRIPTION OF THE INVENTION

Figure 1:
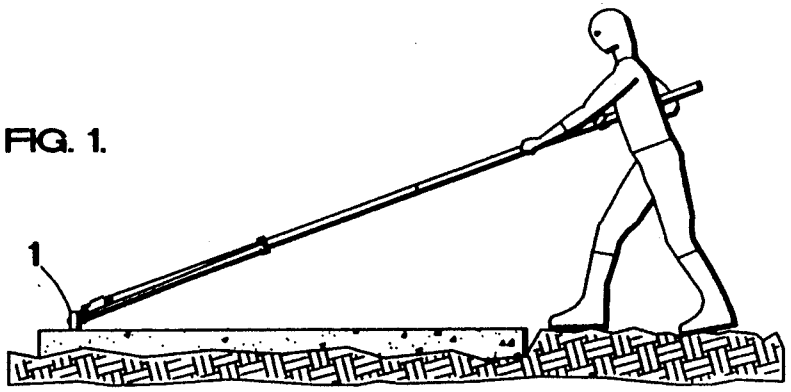
FIG. 1, FIG. 2, and FIG. 3 are side, front, and top views respectively of the deflection indicating adjustable highway straight-edge being used by a workman finishing a flat concrete surface.

The electronic adjustable highway straight-edge consists of a rectangular tube of moderate length. The preferred material for the tube is magnesium. Located at the ends of the tube, plates of sufficient thickness to resist deformation under stress are used to both close the ends of the tube and provide mounting points for two steel cables. The preferred material for the plates is aluminum. The steel cables, located as near as possible and just inside the shortest faces of the rectangular tube, are stretched between the end plates and placed under tension. The tension is adjusted by turning a bolt joined to the cable by a threaded coupling. The two bolt heads are accessible from outside one of the end plates. At the opposite end, the cables are threaded into the end plate, functioning as an anchor point for the cables.

As the straight-edge becomes bowed from use, a wrench is used to tighten one tension cable and loosen the other. This places compressive stress on one side of the straight-edge which compensates for the unbalanced internal stress due to wear, resulting in the desired straightening effect.

In conjunction with the tension cables this invention uses a laser light beam and electronic sensors inside the tube to detect when the straight-edge requires adjustment. These components also greatly facilitate the adjustment procedure.

The deflection detection components primarily consist of a laser light source, four phototransistors with electronic circuits, a plate containing a small light passage or aperture, an on-off switch, batteries, and five light emitting diodes (LEDS). The components are arranged inside the straight-edge tube with the on-off switch and five LED indicator lights, one green and four red, visible at the end plate near the cable adjustment bolts. The laser light source is mounted on one of the end plates and the four phototransistors are mounted at the opposite end plate forming a cross shaped target pattern. The aperture is located at the center of the beam.

When checking the straight-edge for deflection the on-off switch is depressed. When the straight-edge tube is straight, a beam of light is projected through the aperture to exactly between all four phototransistors. The electronic circuits are activated such that a green light will indicate that the straight-edge is straight and in no need of adjustment. When the straight-edge tube becomes bowed the beam of light is projected onto one of the phototransistors. This activates the appropriate electronic circuit and one of the red indicator lights will illuminate. This indicates that the straight-edge is in need of adjustment. The relative position of any illuminated red light, relative to the other lights which are off, indicate which vertical or horizontal direction the center of the straight-edge is deflected, so that the appropriate corrections can be made.

Since any deflection problems occur primarily in the vertical direction, the two tension cables provide adjustment only in that axis. Any deflections in the horizontal axis are indicated for information purposes and if correction is needed, minor bending or replacement of the straight-edge tube may be required.

Figure 2:
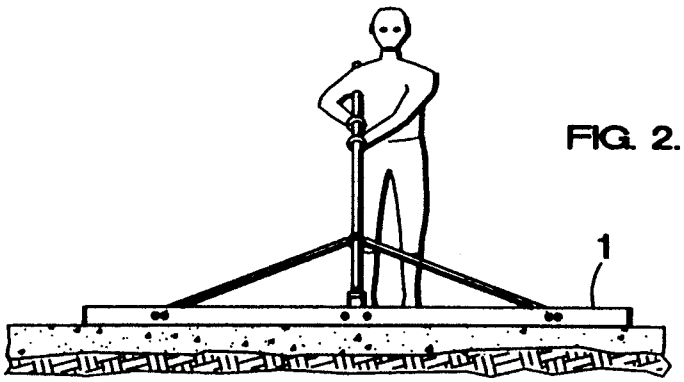
Figure 3:
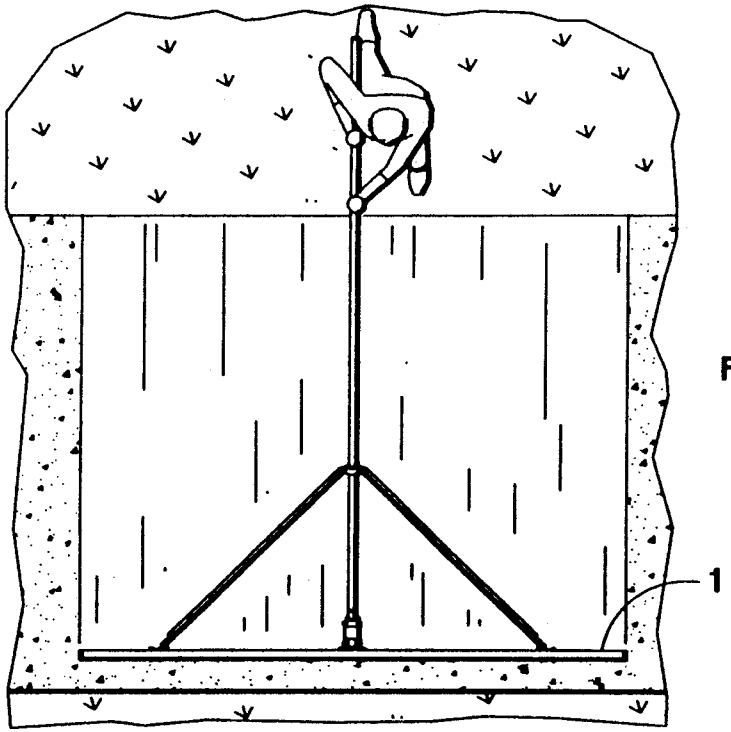

FIG. 1, FIG. 2, and FIG. 3 are side, front, and top views respectively, of highway straight-edge being used by a workman during final finish leveling of an area of wet concrete, that is, depicting tube 1 in contact with wet concrete.

Figure 4:
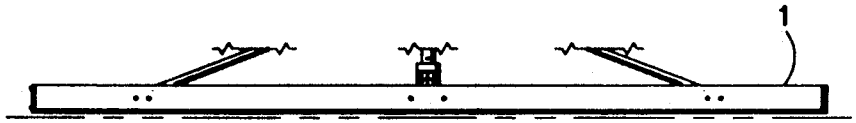
FIG. 4 is a front view of the deflection indicating adjustable highway straight-edge in its normal straight condition.

FIG. 4 is a front view of tube 1 in its normal straight condition. The lower edge is parallel to the straight line.

Figure 5:
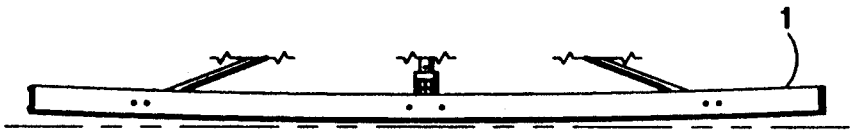
FIG. 5 is a front view of the deflection indicating adjustable highway straight-edge with its center deflected vertically downward.

FIG. 5 details tube 1 after it has experienced normal wear due to abrasion from wet concrete. The center is bowed downward.

Figure 6:
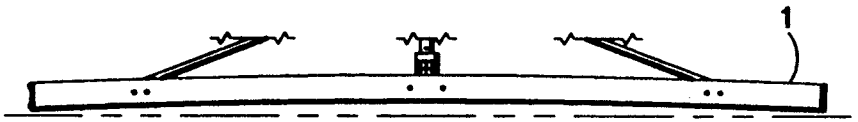
FIG. 6 is a front view of the deflection indicating adjustable highway straight-edge with its center deflected vertically upward.

FIG. 6 details tube 1 after it has been turned upside down in an effort to equalize wear. Note that the center is bowed upward and is not straight. This vertical deflection limits its usefulness as a highway straight-edge.

Figure 7:
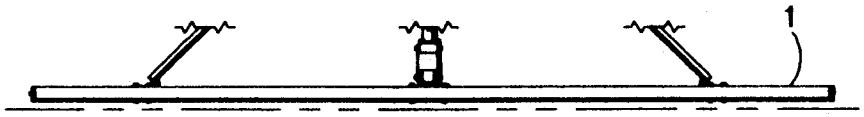
FIG. 7 is a top view of the deflection indicating adjustable highway-straight edge in its normal straight condition.

FIG. 7 is a top view of tube 1 in its normal straight condition. The forward edge is parallel to the straight line.

Figure 8:
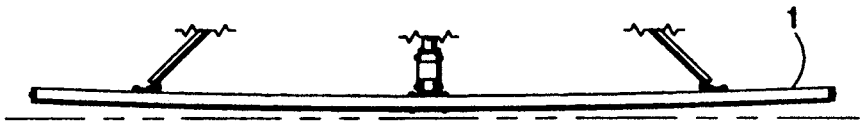
FIG. 8 is a top view of the deflection indicating adjustable highway straight-edge with its center deflected horizontally away from the user.
Figure 9:
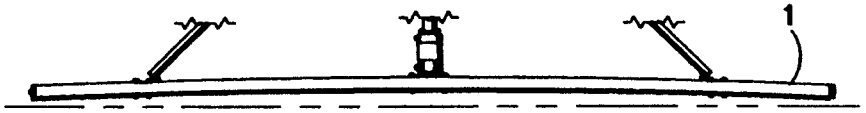
FIG. 9 is a top view of the deflection indicating adjustable highway straight-edge with its center deflected horizontally toward the user.

FIG. 8 and FIG. 9 details tube 1 with its center bowed away from and toward the user respectively, and is in either case not straight. This horizontal deflection, though not as serious as vertical deflection, is of concern when the straight-edge is used at an angle away from normal to the concrete surface.

If undetected or uncorrected, the deflections from a true straight-edge will result in finished concrete which does not meet the specified degree of flatness.

Figure 10:
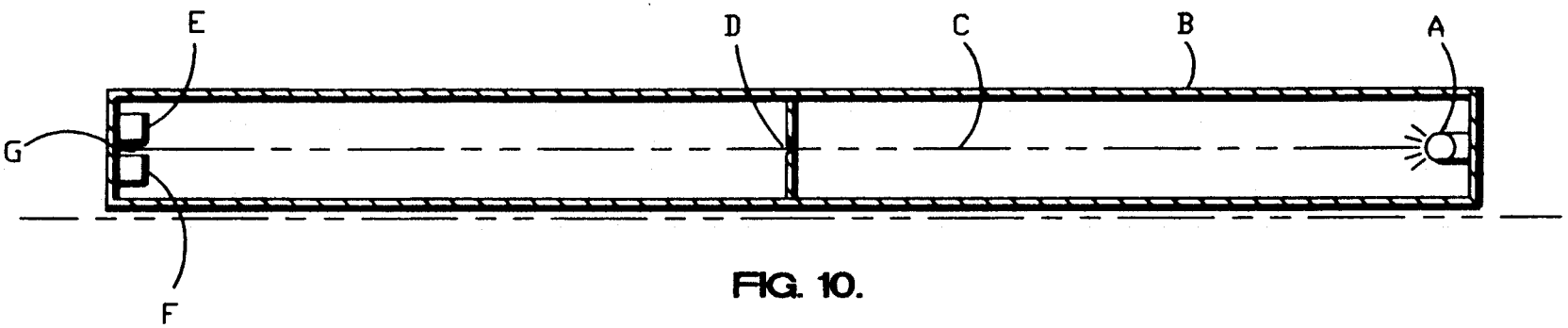
FIG. 10 is a cross-sectional view of the deflection indicating adjustable highway straight-edge in its normal straight condition showing a beam of light passing through an aperture and striking a point between to photo sensors.

FIG. 10 is a cross-sectional view detailing the deflection indicating adjustable highway straight-edge in accordance with the invention. A light source "A" is mounted to the end of tube "B". This projects a beam of light "C" through an aperture "D" mounted to the center of the tube "B". When the tube "B" is straight, the beam of light "C" falls in between the photo sensors "E" and "F" at point "G".

Figure 11:
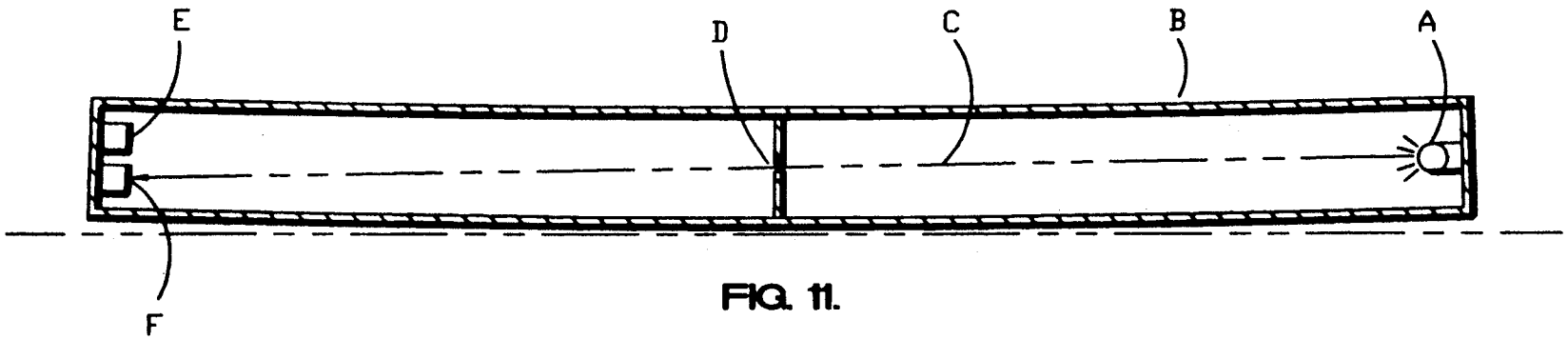
FIG. 11 is a cross-sectional view of the invention with its center deflected downward showing a beam of light passing through an aperture and striking the lower photo sensor.

FIG. 11 details the center of the tube "B" deflected downward. Because the beam of light "C" travels in a straight line it strikes the lower photo sensor "F".

Figure 12:
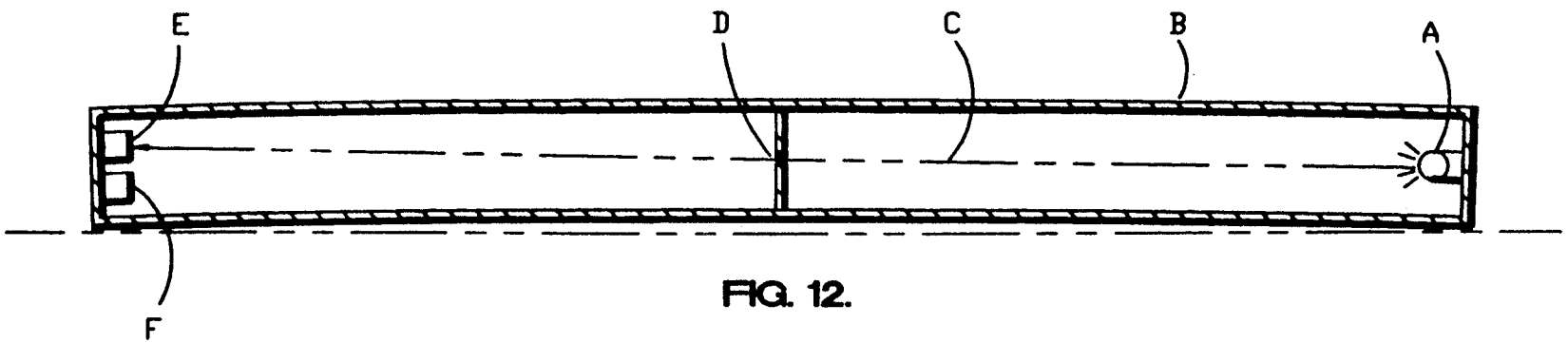
FIG. 12 is a cross-sectional view of the invention with its center deflected upward showing a beam of light passing through an aperture and striking the upper photo sensor.

FIG. 12 details the center of the tube "B" deflected upward. Similar to FIG. 11 the beam of light "C" strikes the upper photo sensor "E".

In each case the photo sensors "E" and "F" can be used to control a variety of indicators including lights, light emitting diodes (LEDS), or audible alarms.

Figure 13:
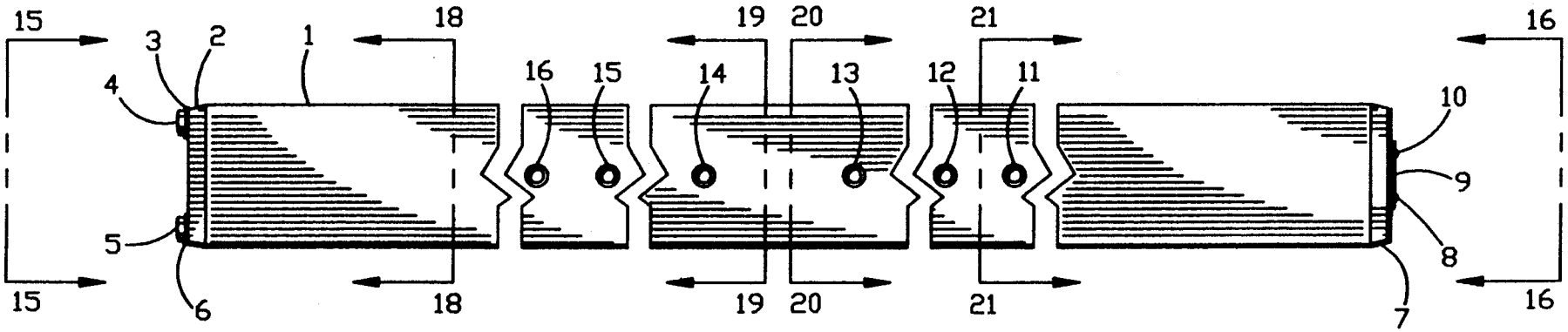
FIG. 13 is a front view of the tube portion of the deflection indicating adjustable highway straight-edge in accordance with the invention.

FIG. 13 details an external front view of the invention broken into sections for purposes of illustration. At the end of tube 1 is end plate 7, and at the opposite end a split end plate, halves 2 and 17 (shown in FIG. 14). The split end plate could be a single plate, however the split design provides easier assembly of the components. Six holes through the tube 1 contain spacers 11, 12, 13, 14, 15, and 16 which provide mounting points and prevent collapsing when any handles or support brackets are through-bolted to the tube 1.

Figure 14:
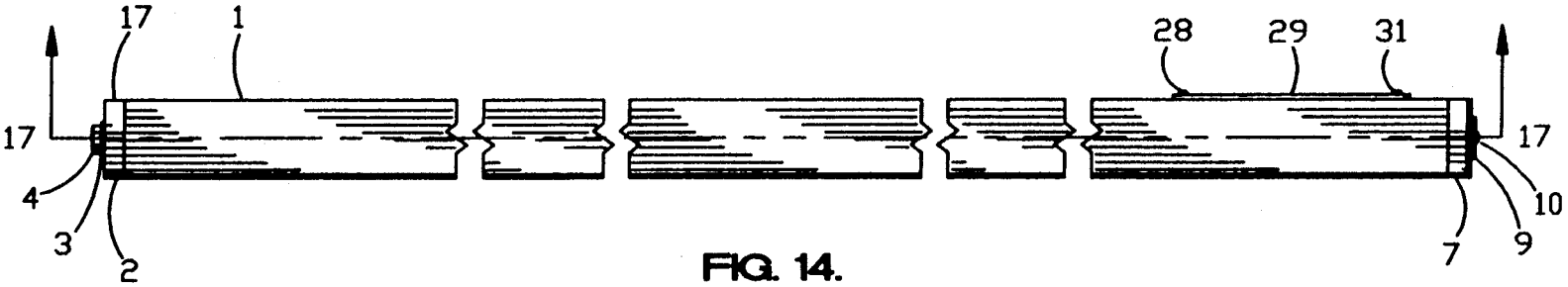
FIG. 14 is a top view of the tube portion of the deflection indicating adjustable highway straight-edge.
Figure 20:
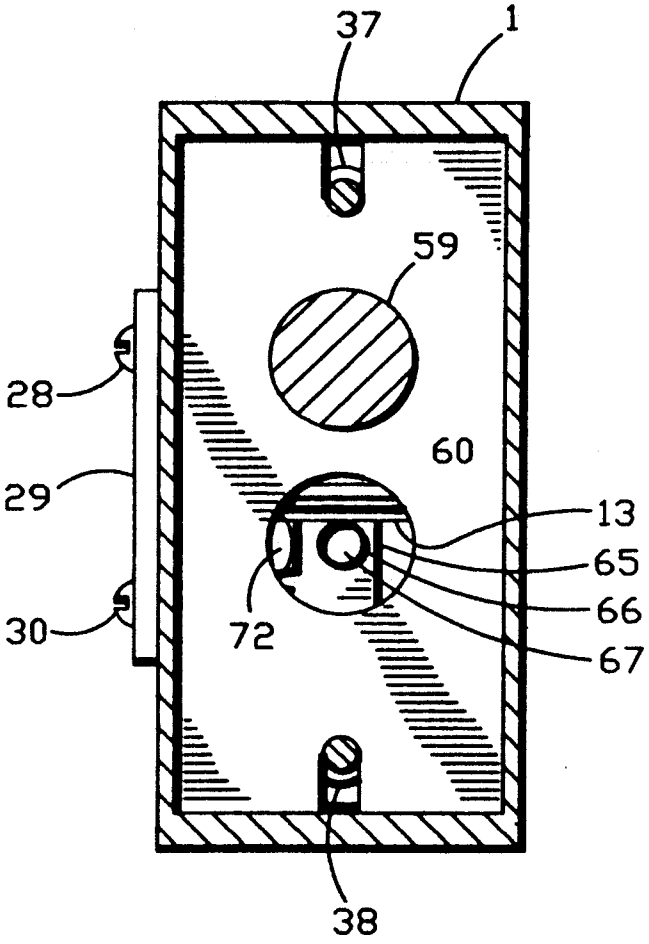
FIG. 20 is a cross-sectional view taken on the plane indicated at 20—20 in FIG. 13.

FIG. 14 is a top view of FIG. 13. A plate 29 is fastened to the tube 1 with four machine screws 28, 30, 31, and 32. Screws 30 and 32 are shown in FIG. 20 & 17E, respectively.

Figure 15:
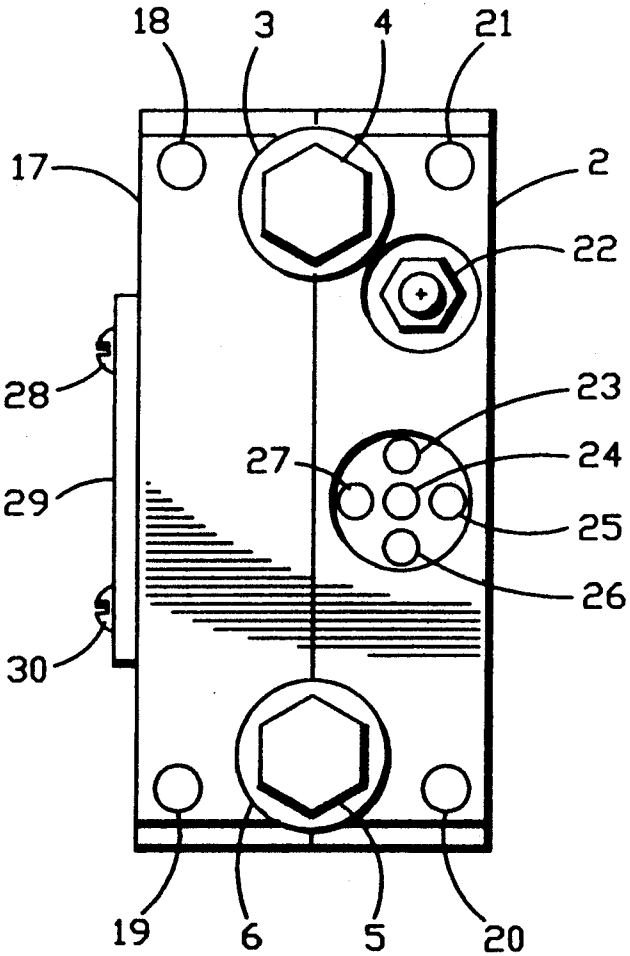
FIG. 15 is an end view of the left end plate of the invention.

FIG. 15 is a left end view of FIG. 13. The end plates 2 and 17 are located by four pins 18, 19, 20, and 21, which extend through the plates 2 and 17 to a short distance inside the interior corners of the tube 1. The end plates 2 and 17 locate bolts 4 and 5. A switch 22, and five LED indicators 23, 24, 25, 26, and 27 are mounted to end plate 2. Flat washers 3 and 6 are used under the heads of the bolts 4 and 5.

Figure 16:
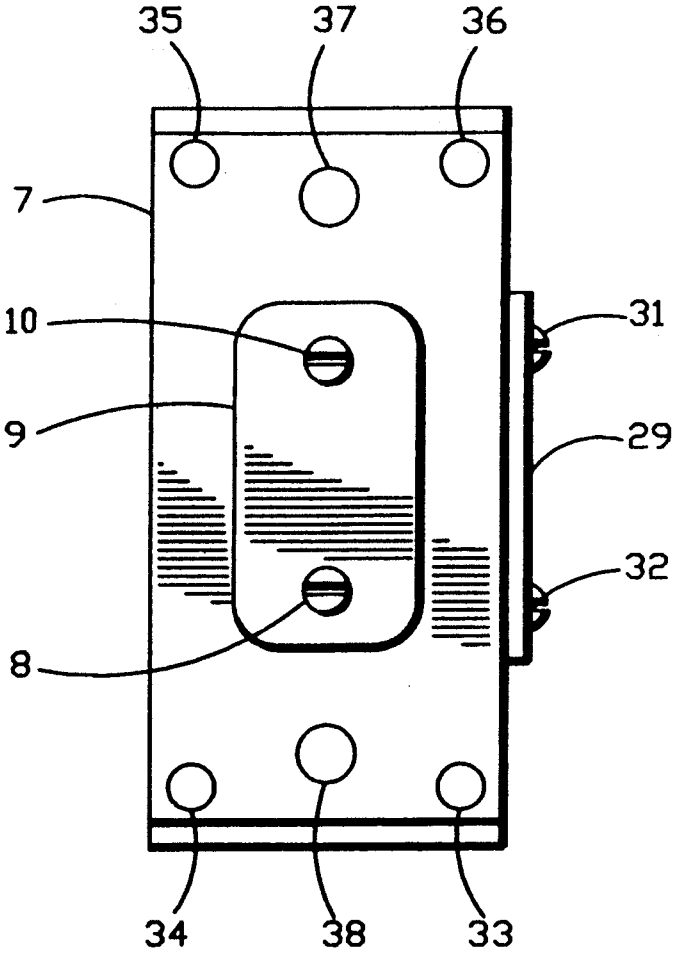
FIG. 16 is an end view of the right end plate of the invention.

FIG. 16 is a right end view of FIG. 13. The end plate 7 is located by four pins 33, 34, 35, and 36, which extend through the plate 7 to just inside the interior corners of the tube 1. The plate 7 has threaded holes which accept the threaded ends of steel cables 37 and 38. The end plate 7 locates the light source adjustment plate 9. The adjustment plate 9 locates two machine screws 8 and 10, which extend though adjustment plate 9, through slots in end plate 7, and thread into light source bracket 65 (shown in FIG. 17E).

FIGS. 17A, 17B, 17C, 17D, and 17E are cross-sections of the invention taken at plane 17—17 in FIG. 14. FIG. 18, 19, 20 and 21 are cross-sections taken in FIG. 13 at planes 18—18, 19—19, 20—20, and 21—21 respectively.

Figure 17A:
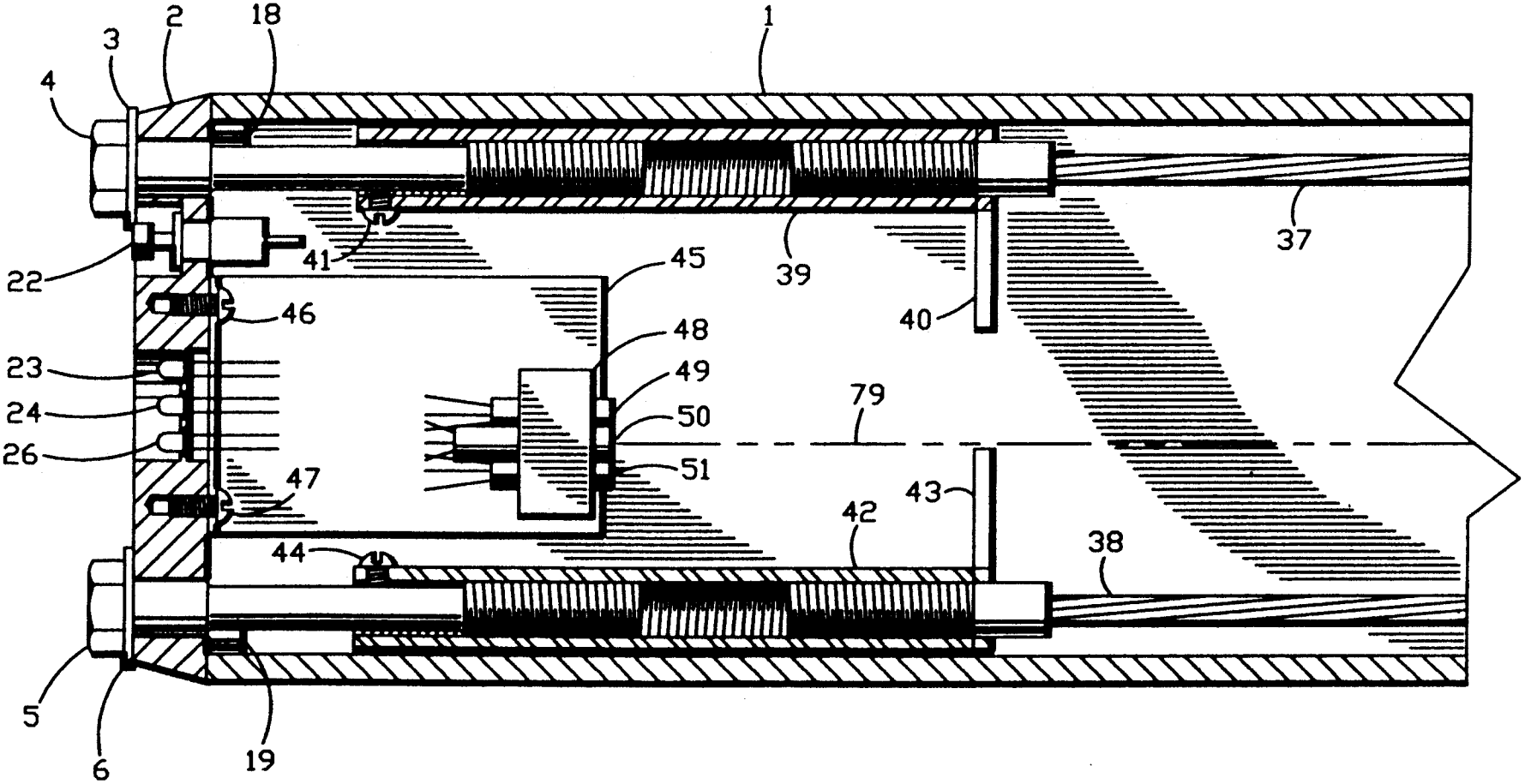
FIG. 17 (A,B,C,D, & E) is a longitudinal sectional view taken on the plane indicated at 17—17 in FIG. 14.
Figure 17E:
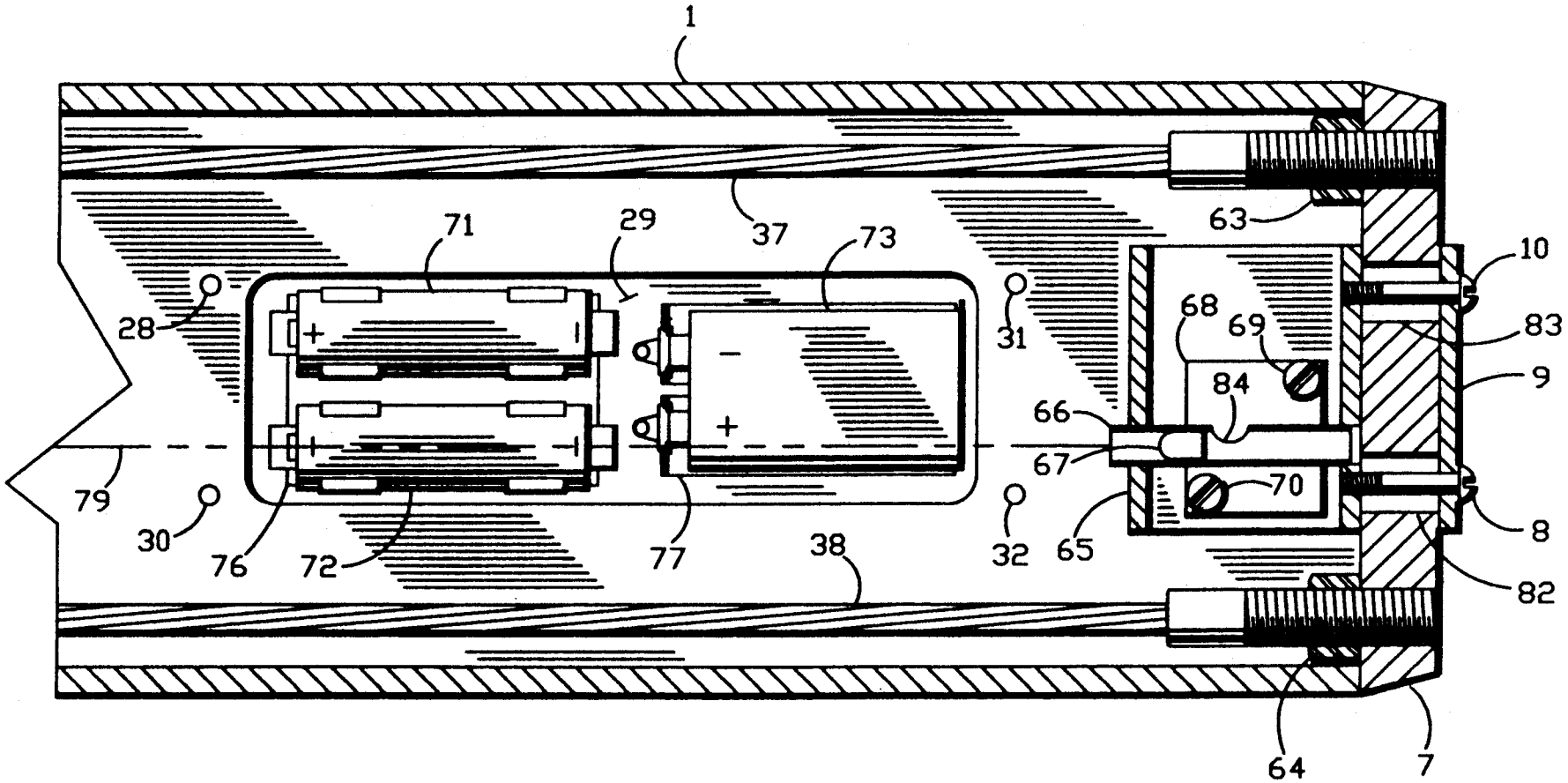
Figure 19:
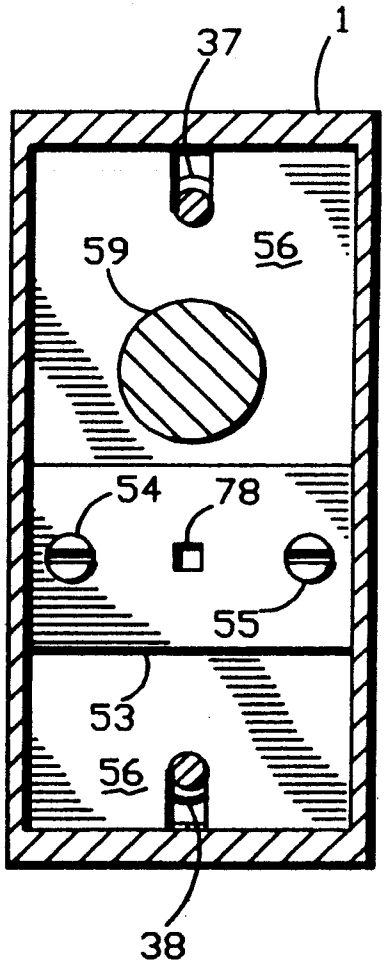
FIG. 19 is a cross-sectional view taken on the plane indicated at 19—19 in FIG. 13.
Figure 18:
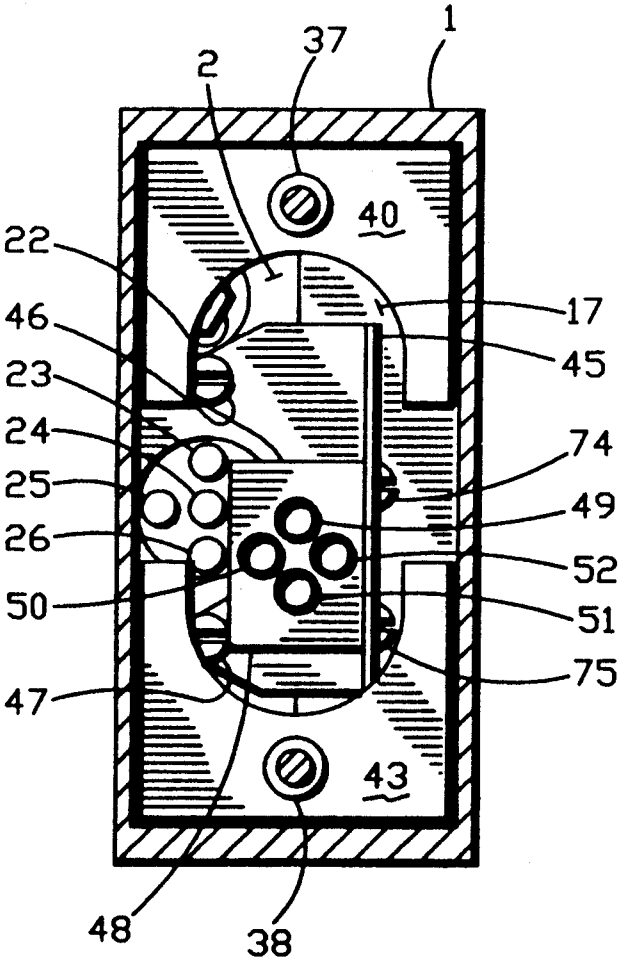
FIG. 18 is a cross-sectional view taken on the plane indicated at 18—18 in FIG. 13.
Figure 21:
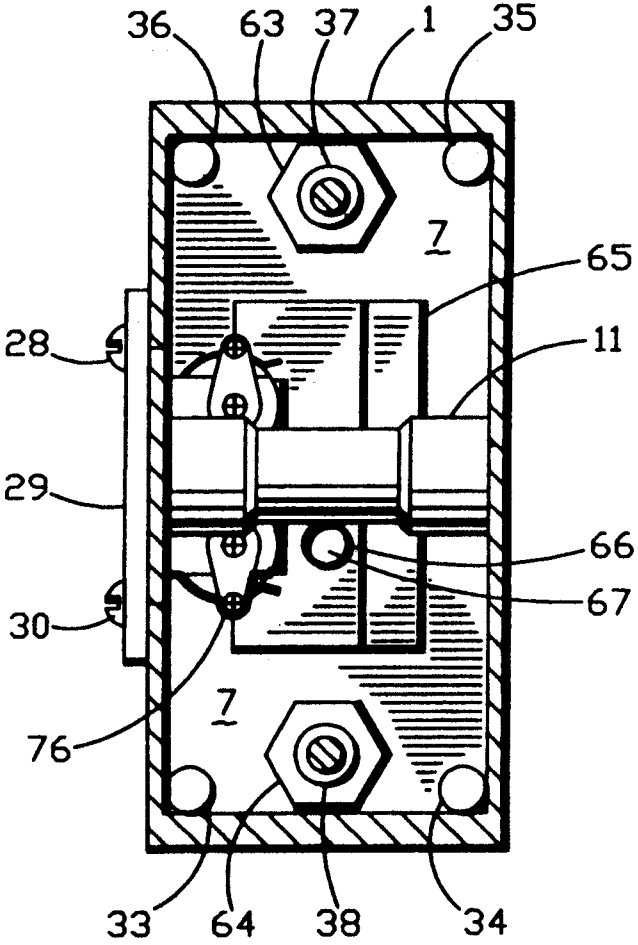
FIG. 21 is a cross-sectional view taken on the plane indicated at 21—21 in FIG. 13.

FIG. 17A details adjustment bolt 4 threaded into internal threaded coupling 39. The end of steel cable 37 is also threaded into coupling 39. Rotation stop 40 is welded to coupling 39 forming a single part. Similarly adjustment bolt 5 is threaded into internal threaded coupling 42 and end of steel cable 38 is also threaded into coupling 42. Rotation stop 43 is welded to coupling 42 forming a single part. Steel cables 37 and 38 are threaded into light source end plate 7 and secured with lock nuts 63 and 64 (shown in FIG. 17E). Tightening adjustment bolts 4 and 5 place steel cables 37 and 38 in tension. Machine screws 41 and 44 protrude into reduced diameter shank of bolts 4 and 5. These act as stops to prevent disengagement of bolts 4 and 5 from their respective couplings 39 and 42. Four phototransistors 49, 50, 51, and 52 (shown in FIG. 18) are mounted through holes in block 48. Block 48 is fastened to circuit board 45 with machine screws 74 and 75 (FIG. 18). Circuit board 45 is fastened to end plate 2 with machine screws 46 and 47. The path of the light beam 79 is shown as a phantom line.

Figure 17B:
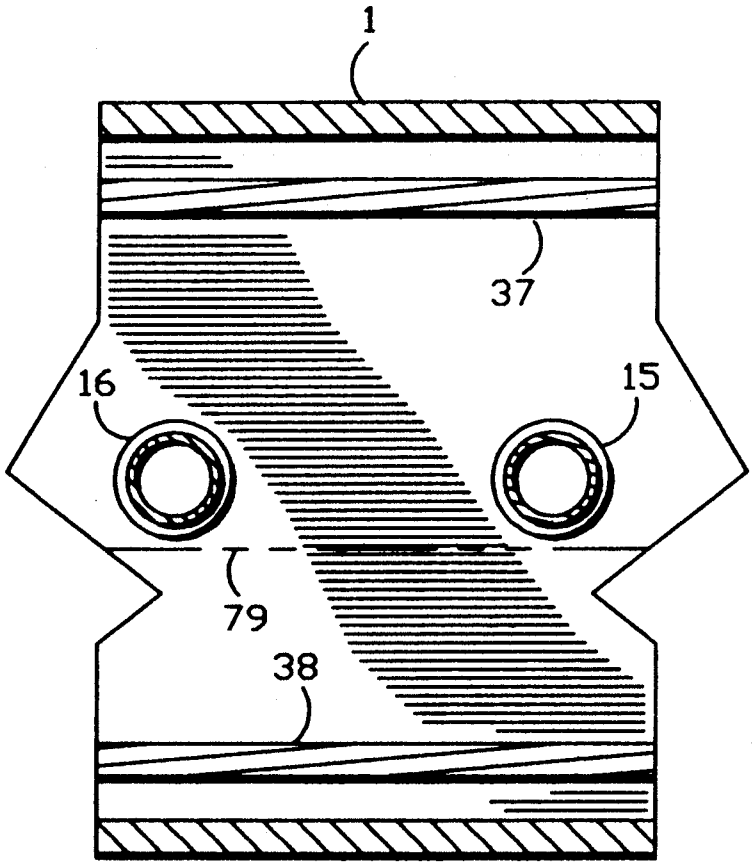

FIG. 17B details spacers 15 and 16 concentric with holes through tube 1 which provide a mounting point for an external support bracket. Cables 37 and 38, and light beam 79, pass through this portion of the tube 1.

Figure 17C:
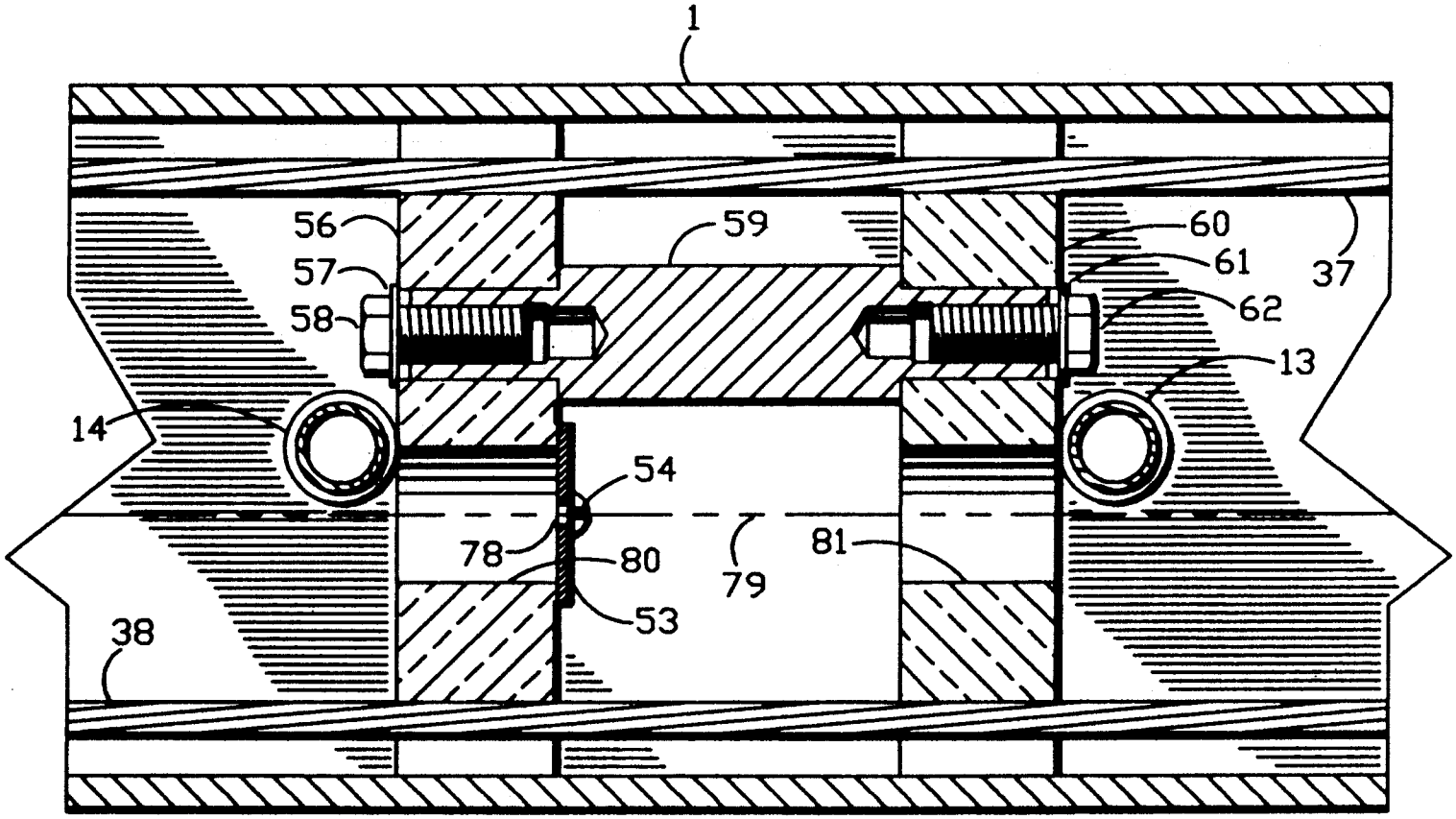

FIG. 17C details cables 37 and 38 passing through slots in cable guide blocks 56 and 60. Guide blocks 56 and 60 provide stability to the cable-tube system when the cables are in tension. Guide block spacer 59 separates guide blocks 56 and 60 forming an assembly with bolts 58 and 62 and flat washers 57 and 61. Guide blocks 56 and 60 are a close sliding fit inside tube 1 to permit assembly. Spacers 13 and 14 are concentric with holes through tube 1 which provide an external handle attachment point. Spacers 13 and 14 locate the guide block assembly in the tube. Aperture plate 53 is fastened to guide block 56 with screws 54 and 55 (shown in FIG. 19). Light beam 79 passes through aperture 78, and holes 80 and 81, in guide blocks 56 and 60 respectively.

Figure 17D:
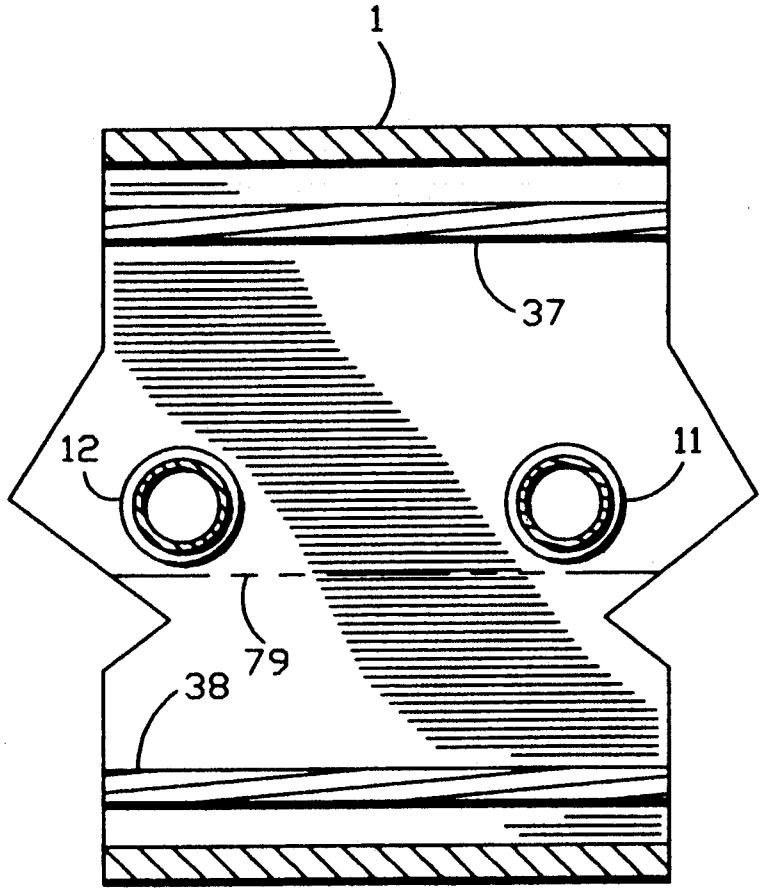

FIG. 17D details spacers 12 and 11 concentric with holes through tube 1 which provide a mounting point for an external support bracket. Cables 37 and 38, and light beam 79, pass through this portion of the tube 1.

FIG. 17E details light source bracket 65 mounted to end plate 7 by machine screws 8 and 10, and plate 9. Initial calibration adjustment of the position of light source 67 can be made by loosening screws 8 and 10 and repositioning plate 9 and bracket 65, in slots 82 and 83, in end plate 7. Screws 8 and 10 are then tightened. Laser light source 67 is located in tube 66. Tube 66 is mounted through holes in bracket 65. This aligns the light source 67 and light beam 79 through aperture 78 toward the center of the four phototransistors 49, 50, 51, and 52 (shown in FIG. 18.). Opening 84 in the side of tube 66 is a passage for electrical conductors (Note: electrical conductors and wires are omitted for clarity.) from light source 67 to small circuit board 68. Circuit board 68 is fastened to bracket 65 with machine screws 69 and 70. Batteries 71, 72, and 73 provide energy to power the light source 67, LEDS 23, 24, 25, 26, 27, (shown in FIG. 18.) and the electronic circuits. The batteries are held by battery holders 76 and 77 which are fastened to plate 29. Battery holder plate 29 is removable from tube 1 to permit battery replacement.

FIGS. 22, 23, 24, 25, 26, and 27, are a detailed description of the adjustment procedure for the invention.

Figure 22:
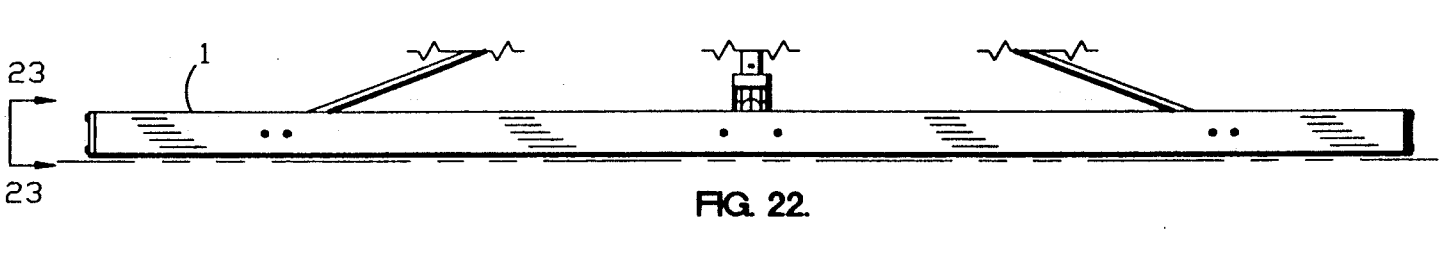
FIG. 22 is a front view of the deflection indicating adjustable highway straight-edge in its normal straight condition.
Figure 23:
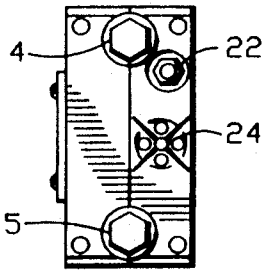
FIG. 23 is an end view taken at plane 23—23 in FIG. 22.

FIG. 22 details a front view of a normally straight deflection indicating adjustable highway straight-edge. In FIG. 23 depressing switch 22 activates the electronics inside the tube 1. Because there is no deflection in the straight-edge a green LED will turn on indicating that no adjustments are required.

Figure 24:
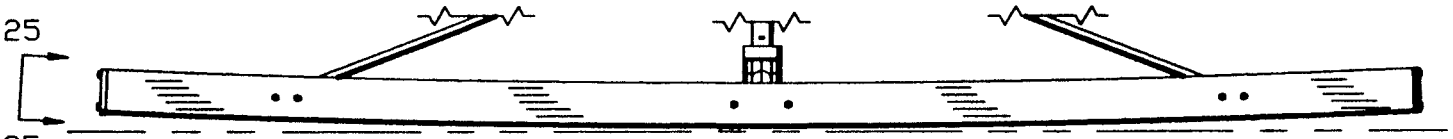
FIG. 24 is a front view of the deflection indicating adjustable highway straight-edge with its center deflected downward.
Figure 25:
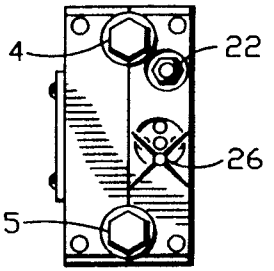
FIG. 25 is an end view taken at plane 25—25 in FIG. 24.

FIG. 24 details the straight-edge deflected downward at the center. In FIG. 25, depressing the switch 22 activates the electronics inside the tube 1. Because the center of the tube 1, containing the aperture 78, is deflected downward, the light beam activates phototransistor 51 and the corresponding red LED 26 turns on. This indicates that the straight-edge is deflected. Tightening adjustment bolt 5 and loosening adjustment bolt 4, until the red LED 26 turns off and the green LED 24 turns on, will result in the straight-edge becoming adjusted straight again.

Figure 26:
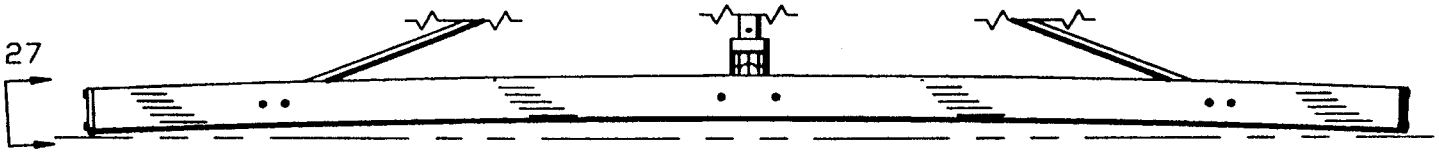
FIG. 26 is a front view of the deflection indicating adjustable highway straight-edge with its center deflected upward.
Figure 27:
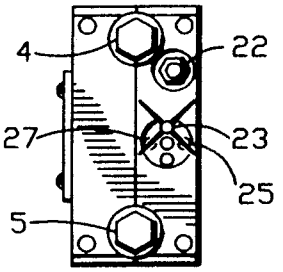
FIG. 27 is an end view taken at plane 27—27 in FIG. 26.

FIG. 26 details the straight-edge deflected upward at the center. In FIG. 27, depressing the switch 22 activates the electronics inside the tube 1. Because the center of the tube 1, containing the aperture 78, is deflected upward, the light beam activates phototransistor 49 and the corresponding red LED 23 turns on. This indicates that the straight-edge is deflected. Tightening adjustment bolt 4 and loosening adjustment bolt 5, until the red LED 23 turns off and the green LED 24 turns on, will result in the straight-edge returning to its normal straight condition.

If when depressing switch 22, either LED 25 or LED 27 turns on, it is an indication that the straight-edge tube 1 is deflected in the corresponding horizontal direction. In this example, a means of corrective adjustment is not provided for horizontal deflection, however it is possible by adding additional steel tensioning cables, adjusting bolts and related components. Indications of deflection in the horizontal are useful in helping the user determine when a problem exists.

Figure 28:
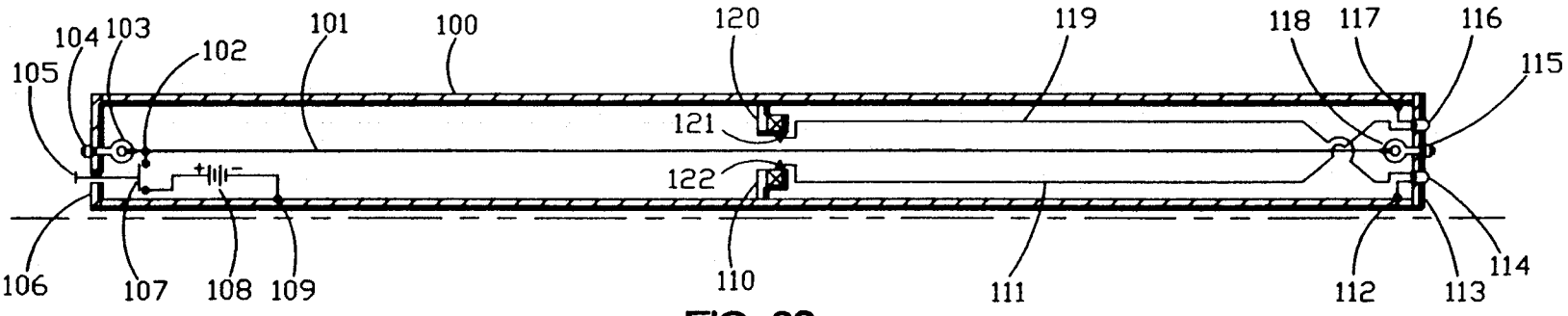
FIG. 28 is a cross-sectional view of an alternative embodiment of the adjustable highway straight-edge beam in its normal straight condition.
Figure 29:
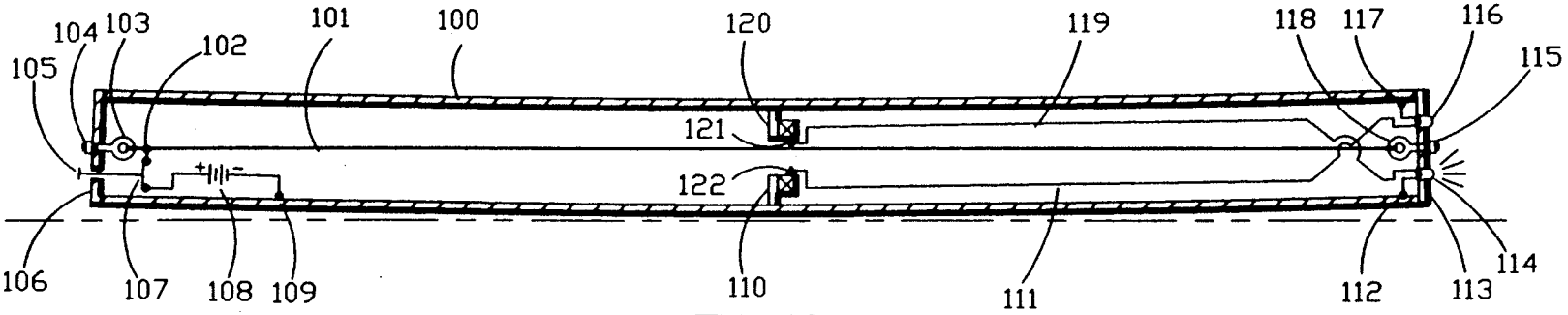
FIG. 29 is a cross-sectional view of the alternative embodiment of FIG. 28 with its center deflected downward.
Figure 30:
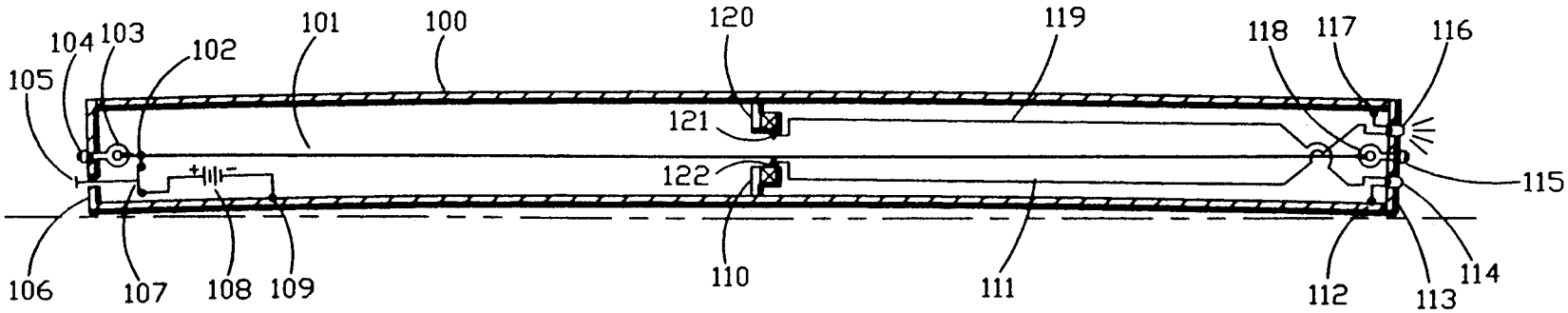
FIG. 30 is a cross-sectional view of the alternative embodiment of FIG. 28 with its center deflected upward.

FIGS. 28, 29, and 30 detail an alternative embodiment of the invention. For clarity the deflection adjustment tension cables and related components are not shown.

In this embodiment, as shown in FIG. 28, electrically conductive steel wire 101 is stretched tightly inside the straight-edge tube 100 from eye-bolt 103 to eye-bolt 118. The wire 101 is securely fastened to and electrically insulated from the eye-bolts 103 and 118. The eye-bolt 103 passes through end plate 106 and is retained by threaded nut 104 to the end plate 106. The eye-bolt 118 passes through end plate 113 and is retained by threaded nut 115 to the end plate 113. The wire 101 passes in close proximity to electrical contacts 121 and 122 which are located by mountings 120 and 110 near the center of the tube 100. The electrical contacts 121 and 122 are electrically insulated from the tube 100. Electrical power is supplied to the wire 101 at connection 102 by battery 108 through switch contacts 107. Switch contacts 107 are normally open and are closed by depressing switch button 105. The negative terminal of the battery 108 is grounded to the tube 100 at connection 109. Tube 100 is electrically conductive magnesium. Upper electrical contact 121 is connected to indicator light 114 by conductor wire 119. Indicator light 114 which is mounted to and visible through end plate 114, is grounded to tube 100 at connection 112. Lower electrical contact 122 is connected to indicator light 116 by conductor wire 111. Indicator light 116 which is mounted to and visible through end plate 114, is grounded to tube 100 at connection 117.

FIG. 28 details the straight-edge tube 100 in its normal straight condition. Wire 101 passes in close proximity to and in between electrical contacts 121 and 122 without making contact. Depressing switch 105 applies battery voltage to wire 101. Because wire 101 does not touch either contact 121 or 122 the indicator lights 114 and 116 remain off. No lights illuminated indicates to the user that the straight-edge tube 100 is straight and in no need of adjustment.

FIG. 29 details the center of the tube 100 deflected downward. Because the wire 101 is under tension it remains straight inside the tube 100 and touches upper contact 121. Depressing switch 105 applies battery voltage to wire 101. Because wire 101 is touching contact 121 a complete electric circuit is made and the lower indicator light 114 illuminates. This indicates to the user that the straight-edge tube 100 is deflected downward at its center and corrective adjustments are necessary. The distances and deflections illustrated are exaggerated for clarity.

FIG. 30 details the center of the tube 100 deflected upward. Because the wire 101 is under tension it remains straight inside the tube 100 and touches lower contact 122. Depressing switch 105 applies battery voltage to wire 101. Because wire 101 is touching contact 122 a complete electric circuit is made and the upper indicator light 116 illuminates. This indicates to the user that the straight-edge tube 100 is deflected upward at its center and corrective adjustments are necessary. The distances and deflections illustrated are exaggerated for clarity.

The deflection correction adjustment procedure for this embodiment is the same as described earlier. The advantage of this embodiment over the preferred embodiment is reduced complexity and cost because electronic circuits would be necessary. One disadvantage is that the wire 101 may vibrate if the straight edge were accidentally jarred during checking and adjustment procedures. This would cause the indicator lights 114 and 116 to rapidly blink on and off temporarily. A means of vibration damping for the steel wire 101 would be helpful in preventing unintentional blinking of the indicator lights.

For the detection method just described only two electrical contacts and indicator lights are shown for clarity. Additional electrical contacts and corresponding indicator lights can be utilized to detect and indicate deflection in other directions as necessary. In addition, audible alarms may be used in place of the indicator lights. Each alarm would vary in sound frequency and character corresponding to pre-established conditions of deflection.

Figure 31:
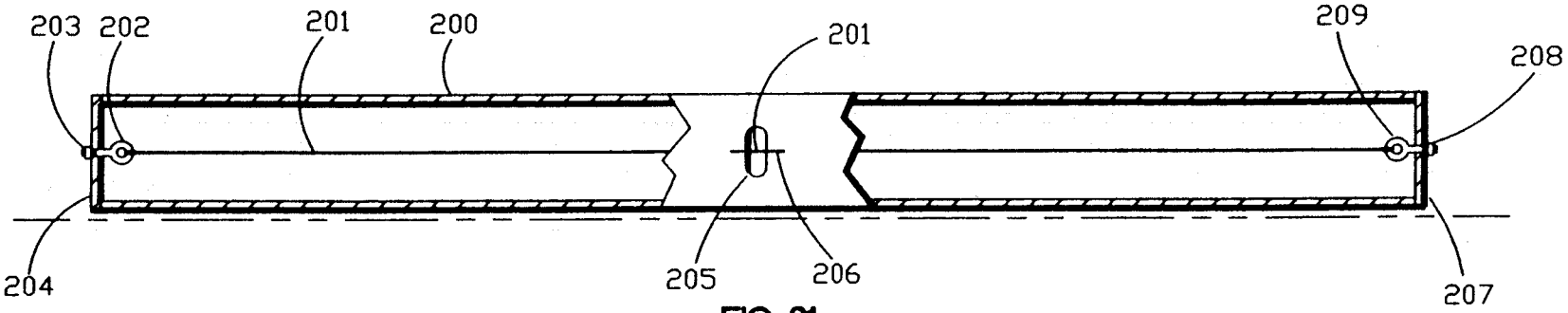
FIG. 31 is a cross-sectional view of another alternative embodiment of the deflection indicating adjustable highway straight-edge in its normal straight condition.
Figure 32:
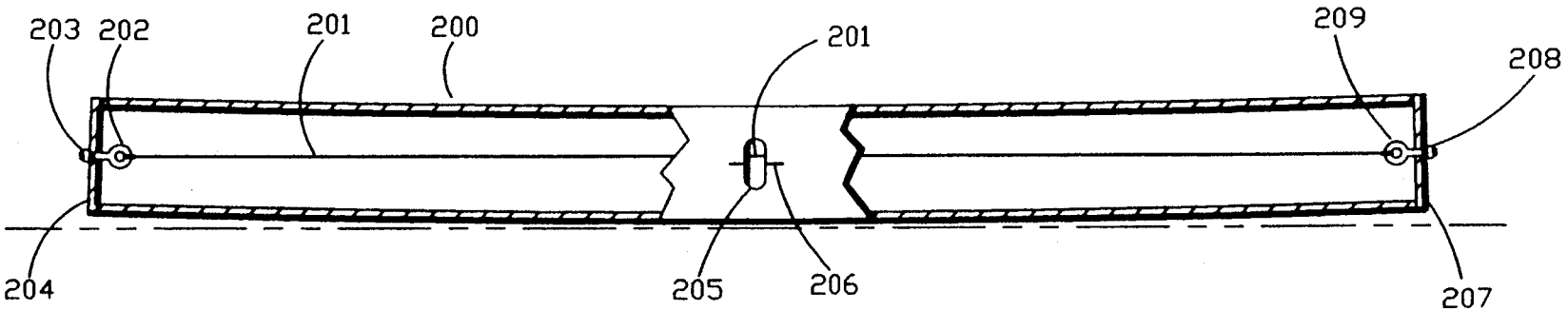
FIG. 32 is a cross-sectional view of the alternative embodiment of FIG. 31 with its center deflected downward.
Figure 33:
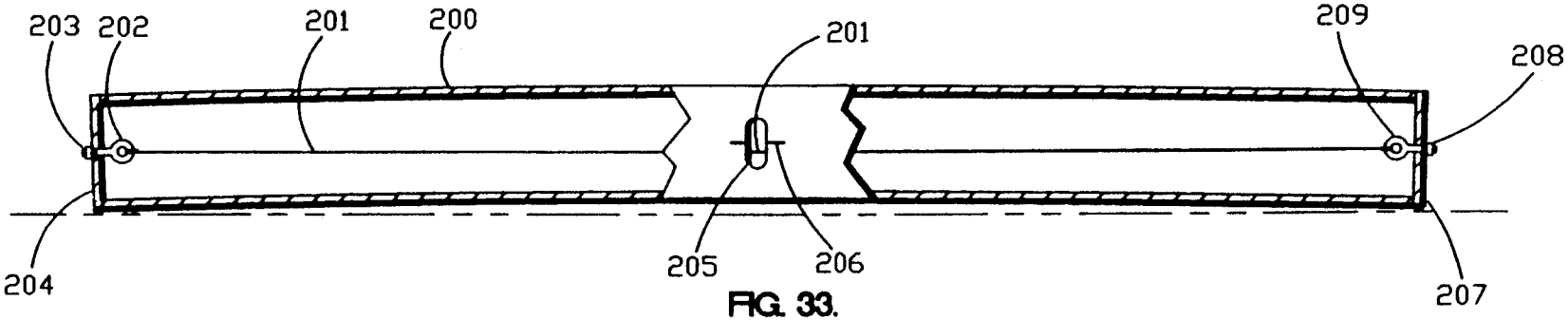
FIG. 33 is a cross-sectional view of the alternative embodiment of FIG. 31 with its center deflected upward.

FIGS. 31, 32, and 33 detail another alternative embodiment of the invention. Again, for clarity the deflection adjustment tension cables and related components are not shown.

In this embodiment, shown in FIG. 31, a steel wire or string line 201 is stretched tightly inside the straight-edge tube 200 from eye-bolt 209. The material of the sight-wire 201 is not limited to steel. Various other materials such as a plastic fishing line would also be suitable. High contrast or reflective backgrounds to the sight-wire can also be used to improve visual indications. The sight-wire 201 is securely fastened to the eye-bolts 202 and 209. The eye-bolt 202 passes through end plate 204 and is retained by threaded nut 203 to end plate 204. The eye-bolt 209 passes through end plate 207 and is retained by threaded nut 208 to end plate 207. The sight-wire 201 passes near and is visible through sight window 205 in the side of the tube 200. The sight window is located near the center of the tube 200. A permanent reference mark 206 is visible on the tube near the sight window 205. The location of the reference mark 206 is aligned exactly with the sight-wire 201 and is established when the straight-edge tube is new and perfectly straight.

The straight-edge tube 200 is shown in its normal straight condition. Sight-wire 201 passes near the sight window and the reference mark 206. Exact alignment of the sight-wire 201 to the reference mark 206 indicates to the user that the straight-edge tube is straight and in no need of adjustment.

FIG. 32 details the center of the tube 200 deflected downward. Because the sight-wire 201 is under tension it remains straight inside the tube 200 and moves out of alignment above the reference mark 206. This indicates to the user that the straight-edge tube 200 is deflected downward at its center and corrective adjustments are necessary. The distances and deflections illustrated are exaggerated for clarity.

FIG. 33 details the center of the tube 200 deflected upward. Because the sight-wire 201 is under tension it remains straight inside the tube 200 and moves out of alignment below the reference mark 206. This indicates to the user that the straight-edge tube 200 is deflected upward at its center and corrective adjustments are necessary. The distances and deflections illustrated are exaggerated for clarity.

The deflection correction adjustment procedure would be similar to the Electronic Adjustable Highway Straight-Edge Adjustment Procedure described earlier. The only difference is the method of deflection detection.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A deflection indicating adjustable highway straight-edge comprising:

a substantially rectangular tube having a plate at each end and a flat straight bottom surface;

at least two adjustable cables, stretched within said tube, attached to said end plates;

adjusting means, connected to said cables, for adjusting the tension of said cables;

deflection sensing means for providing a signal representative of the deflection of the bottom surface of said tube from its straight condition;

indicating means for transforming the signal produced by said deflection sensing means to indicate to the user when sufficient tension has been applied to said adjustable cables to restore the bottom of said tube to its straight condition.

2. The deflection sensing means of claim 1 further comprising a light source within said tube adjacent to one end, wherein said light source is adapted to produce a beam of light corresponding in position to the deflection of said bottom surface of said tube from its normal straight position.

3. The light source of claim 2 further comprising a laser.

4. The indicating means of claim 3 further comprising:

a plurality of photosensitive cells within said tube adjacent to the other end of said tube, to receive said beam of light and produce a visual signal to the user indicative of the direction of the deflection to enable the user to adjust the bottom surface of said tube to its straight condition. to its straight condition.

5. The tube of claim 4 wherein said tube is made of magnesium steel.

6. The deflection sensing means of claim 1 further comprising:

a conductive wire within said tube attached adjacent to the ends of said tube;

a plurality of switches within said tube, substantially equidistant between the ends of said tube, wherein a deflection of the bottom surface of said tube results in a said wire making a contact with at least one of said switches, with said contact producing a signal corresponding in position to the deflection of said bottom surface of said tube from its normal straight position.

7. The indicating means of claim 6 further comprising:

a plurality of lights, each of said lights corresponding to a particular switch, wherein a contact by said wire with a switch causes that light to be illuminated thereby, indicating the direction of deflection of the bottom surface of said tube.

8. The deflection sensing means of claim 1 further comprising a wire within said tube, attached adjacent to said ends.

9. The indicating means of claim 8 further comprising a window positioned within said tube positioned so that said wire is visible;

indicia, adjacent to said window, to indicate changes of position of said wire within said window, with said indicia providing the direction of deflection of the bottom surface of said tube.

* * * * *